US010208547B2

(12) United States Patent
Kjørholt et al.

(10) Patent No.: US 10,208,547 B2
(45) Date of Patent: Feb. 19, 2019

(54) INCREASING HYDROCARBON RECOVERY FROM RESERVOIRS

(71) Applicant: Statoil Petroleum AS, Stavanger (NO)

(72) Inventors: Halvor Kjørholt, Trondheim (NO); Jan Håvard Jøranson, Stavanger (NO); Fredrik Varpe, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/722,320

(22) Filed: Oct. 2, 2017

(65) Prior Publication Data

US 2018/0023351 A1 Jan. 25, 2018

Related U.S. Application Data

(63) Continuation of application No. 14/778,927, filed as application No. PCT/EP2014/055716 on Mar. 21, 2014, now abandoned.

(30) Foreign Application Priority Data

Mar. 21, 2013 (GB) ..... 1305208.9

(51) Int. Cl.
*E21B 43/25* (2006.01)
*E21B 43/26* (2006.01)
(Continued)

(52) U.S. Cl.
CPC ..... *E21B 17/18* (2013.01); *E21B 33/124* (2013.01); *E21B 34/06* (2013.01); *E21B 43/14* (2013.01); *E21B 43/255* (2013.01); *E21B 43/26* (2013.01)

(58) Field of Classification Search
CPC ..... E21B 17/18; E21B 33/124; E21B 34/06; E21B 43/14; E21B 43/255; E21B 43/26
See application file for complete search history.

(56) References Cited

U.S. PATENT DOCUMENTS 2,494,803 A 1/1950 Frost et al.
4,683,944 A * 8/1987 Curlett ..... E21B 17/003 166/65.1
(Continued)

FOREIGN PATENT DOCUMENTS

CA 2814750 A1 * 4/2012 ..... E21B 43/26
WO WO 2008/004875 A1 1/2008
(Continued)

*Primary Examiner* — James G Sayre

(74) *Attorney, Agent, or Firm* — Birch, Stewart, Kolasch & Birch, LLP

(57) ABSTRACT

A method, system and apparatus for producing hydrocarbons from a low permeability reservoir formation. A wellbore with a plurality of fractures designated as one of a first or a second set of fractures is provided. A first fluid conduit is formed by an annulus between an outer casing of a tubular and an inner tubular member, and is arranged to transport produced hydrocarbons. An interior of the inner tubular member forms a second fluid conduit which is arranged to transport an injection fluid. A set of first openings is provided in fluid connection with the first fluid conduit, each first opening being located to substantially align with one of a first set of fractures. A set of second openings is provided in fluid connection with the second fluid conduit, each second opening being located to substantially align with one of a second set of fractures. A high pressure fluid is injected into the second set of fractures, which pushes hydrocarbons located in the low permeability reservoir towards the first set of fractures, thereby increasing the recovery rate of hydrocarbons in the low permeability reservoir.

22 Claims, 6 Drawing Sheets

(51) Int. Cl.

| | |
|---|---|
| ***E21B 34/06*** | (2006.01) |
| ***E21B 17/18*** | (2006.01) |
| ***E21B 33/124*** | (2006.01) |
| ***E21B 43/14*** | (2006.01) |

(56) References Cited

U.S. PATENT DOCUMENTS

| | | | | |
|---|---|---|---|---|
| 5,125,691 | A | 6/1992 | Bogdan | |
| 5,335,732 | A * | 8/1994 | McIntyre | E21B 33/124 166/250.01 |
| 5,730,220 | A * | 3/1998 | Ganelin | E21B 43/12 166/242.3 |
| 6,328,112 | B1 * | 12/2001 | Malone | E21B 21/10 166/332.1 |
| 2002/0162596 | A1 | 11/2002 | Simpson | |
| 2005/0072567 | A1 | 4/2005 | Steele et al. | |
| 2005/0252656 | A1 | 11/2005 | Maguire | |
| 2011/0214920 | A1 | 9/2011 | Vail, III et al. | |
| 2013/0220604 | A1 * | 8/2013 | El-Rabaa | E21B 43/26 166/259 |
| 2014/0262240 | A1 | 9/2014 | Boone et al. | |
| 2015/0034329 | A1 | 2/2015 | McGeoch et al. | |
| 2015/0354334 | A1 * | 12/2015 | Richard | E21B 33/124 166/298 |
| 2017/0030173 | A1 | 2/2017 | MacPhail et al. | |
| 2017/0145757 | A1 | 5/2017 | Ayasse | |

FOREIGN PATENT DOCUMENTS

| | | | | |
|---|---|---|---|---|
| WO | WO 2008/048451 | A2 | 4/2008 | |
| WO | WO 2010/092338 | A2 | 8/2010 | |
| WO | WO 2012/054139 | A2 | 4/2012 | |
| WO | WO 2013/130491 | A2 | 9/2013 | |
| WO | WO 2014/124533 | A1 | 8/2014 | |
| WO | WO-2014124533 | A1 * | 8/2014 | E21B 43/12 |

* cited by examiner

INCREASING HYDROCARBON RECOVERY FROM RESERVOIRS

CROSS-REFERENCE TO RELATED APPLICATIONS

This application is a Continuation of U.S. patent application Ser. No. 14/778,927 filed on Sep. 21, 2015, which was filed as the National Phase of PCT International Application No. PCT/EP2014/055716 filed on Mar. 21, 2014, which claims the benefit of priority to British Application No. 1305208.9 filed Mar. 21, 2013, all of which are hereby expressly incorporated by reference into the present application.

TECHNICAL FIELD

The invention relates to the field of increasing hydrocarbon recovery from reservoirs, and in particular shale reservoirs and tight oil reservoirs.

BACKGROUND

Shale reservoirs are hydrocarbon reservoirs formed in a shale formation. It can be difficult to produce the hydrocarbons from shale reservoirs because the shale formation is of low porosity and low permeability. This means that when a well is drilled into the formation, only those fluid hydrocarbons in proximity to the well are produced, as the other hydrocarbons further away from the well have no easy path to the well through the relatively impermeable rock formation.

A typical production system is illustrated in FIG. 1, in which a subterranean shale formation 1 is exploited. A reservoir of liquid hydrocarbons is at a certain depth 2. These are exploited by drilling a horizontal well 3 from a production facility 4 located at the surface. A horizontal well 3 allows a greater length the well to be in contact with the reservoir 2. Note also that substantially vertical wells may be used.

The following discussion refers to shale reservoirs, but the same techniques apply to hydrocarbon recovery from other low porosity, low permeability formations. In order to improve hydrocarbon recovery from shale reservoirs, the shale around the well 3 is often hydraulically fractured, as illustrated in FIG. 2. In the example of FIG. 2, the well is located in a shale (or other low porosity/low permeability) formation 2 bearing hydrocarbons, and surrounded above and below by a cap rock formation 5 and the base rock formation 6 respectively. Once a fracture has been hydraulically induced, it is typically held open using a proppant.

Hydraulic fracturing involves propagating fractures 7 through the shale formation 2 using a pressurized fluid. These fractures create conduits in the low permeability shale formation. Hydrocarbon fluids can then migrate through the conduits towards the well 3. In this way, recovery of hydrocarbons from the reservoir is improved because hydrocarbons that would not previously be able to reach the well now have a path to the well and can be produced.

Hydraulic fracturing leads to a high initial production of hydrocarbons trapped in the shale reservoir. However, this high initial production quickly tails off to a value of typically between 10 and 20% of the initial production rate. Over the lifetime of a shale reservoir well, the well may produce an average of 400-500 BOE (barrels of oil equivalent) per day, peaking in the initial stages at around 1,500 BOE per day.

Furthermore, hydraulic fracturing only leads to a part of the hydrocarbons trapped in the shale being produced. This is because the pattern of the fractures created during the hydraulic fracturing process does not provide access to the entire pore space of the shale formation. Some regions of the shale reservoir are therefore out of reach by the production well 3 due to the low permeability of the shale formation. The production rate also drops because the main driving force pushing hydrocarbons towards the well is fluid expansion due to pressure depletion. The pressure reduces as the hydrocarbons are produced.

SUMMARY

It is an object to improve the efficiency of production of oil from reservoirs in low permeability formations such as shale.

According to a first aspect, there is provided a method of completing a well for producing hydrocarbons from a low permeability reservoir formation. A wellbore is drilled into the low permeability reservoir formation. A hydraulic fracturing operation is performed to induce a plurality of fractures in the reservoir at known locations. Each fracture is designated as either one of a first set of fractures or one of a second set of fractures. The well is completed using a tubular, the tubular comprising an outer casing and a tubular inner member disposed within the outer casing, wherein the tubular inner member and the outer casing define an annulus, the annulus forming a first fluid conduit arranged to transport produced hydrocarbons, and an interior of the inner tubular member forming a second fluid conduit arranged to transport an injection fluid, a set of first openings in fluid connection with the first fluid conduit, each first opening being located to substantially align with one of the first set of fractures, and a set of second openings in fluid connection with the second fluid conduit, each second opening being located to substantially align with one of the second set of fractures. This allows, in use, injection fluid to be applied to the second set of fractures which increase the pressure in the formation and pushes hydrocarbons towards the first set of fractures, making hydrocarbons easier to produce.

As an option, a valve is provided to at least some of the first set of openings, the valve arranged to control a flow of hydrocarbons into the first fluid conduit. This allows flow to be controlled or substantially shut of in the event of an unwanted water or gas breakthrough.

Valves may also be provided to at least some of the second set of openings, the valve arranged to control a flow of injection fluid from the second fluid conduit. An advantage of this is that, in use, the valves can maintain a similar pressure and/or flow rate of injection fluid into the second set of fractures along the length of the well, to maintain an even pressure of injection fluid in the low permeability formation.

As an option, a packer is disposed in proximity to the first set of openings and a further packer is disposed in proximity to the second set of openings. The packers are arranged to ensure no fluid connection between the first set of openings and the second set of openings. In some circumstances, a gravelpack is optionally used instead of packers. While the gravelpack may not ensure that there is no fluid connection between the first and second sets of openings, it will restrict the flow of fluids between the first and second sets of openings and this may be within acceptable levels.

An example of a low permeability reservoir formation is a shale formation, but it will be appreciated that the techniques may be applied to any type of low permeability reservoir formation.

As an option, the first set of fractures and the second set of fractures are disposed along a main axis of the well such that a fracture of the first set of fractures alternates with a fracture of the second set of fractures. This allows more even distribution of pressure from the injection fluid within the well and ensures that as much of the reservoir as possible can be subject to pressure from the injection fluid to increase hydrocarbon production.

An advantage of having the second fluid conduit as the inner conduit is that it has a smaller diameter and can therefore more easily maintain the high pressure required for the injection fluid.

According to a second aspect, there is provided a method of producing hydrocarbons from a low permeability reservoir formation. A well in a low permeability reservoir formation is provided with a plurality of hydraulic fractures, each fracture being designated as one of a first set of fractures and a second set of fractures. An injection fluid is injected from an inner tubular member disposed in an outer casing of a tubular into at least one of the second set of fractures to increase a pressure in the low permeability reservoir. Hydrocarbons are produced from at least one of the first set of fractures such that the hydrocarbons flow into an annular portion of the tubular defined by the outer casing and the inner tubular member.

The flow of hydrocarbons into the production tubular may be controlled using a valve to limit gas or water breakthrough.

A flow of injection fluid may be controlled using a further valve. This allows a substantially uniform flow rate and/or pressure to be injected to all of the second set of fractures.

As an option, at least one packer is provided in proximity to an opening of the first set of openings, and a further packer is disposed in proximity to an opening of the second set of openings. The use of packers ensures that there is no fluid connection between the first set of openings and the second set of openings.

The injection fluid optionally comprises a gas.

It will be appreciated that the steps of injecting an injection fluid and producing hydrocarbons may occur simultaneously or sequentially.

According to a third aspect, there is provided a tubular for producing hydrocarbons from a low permeability reservoir formation. The tubular is provided with an outer casing and a tubular inner member disposed within the outer casing, wherein the tubular inner member and the outer casing define an annulus. The annulus forms a first fluid conduit arranged to transport produced hydrocarbons and an interior of the tubular inner member forms a second fluid conduit arranged to transport an injection fluid. A first opening in the outer casing is in fluid connection with the first fluid conduit, and a second opening in the outer casing is in fluid connection with the second fluid conduit.

As an option, the first fluid opening further comprises a valve, the valve arranged to control a flow of hydrocarbons into the first fluid conduit. This reduces the risk of water or gas being produced in the event of a water or gas breakthrough.

As a further option, the second fluid opening further comprises a further valve, the further valve arranged to control a flow of injection fluid out of the second fluid conduit. This allows even distribution of injection fluid into the formation at all points along the length of the well.

As an option, the tubular is provided with a first packer disposed in proximity to the first opening and a second packer disposed in proximity to the second opening, wherein the packers are arranged to ensure no fluid connection between the first opening and the second opening, thereby reducing the risk of injection fluid entering the first fluid conduit.

According to a fourth aspect, there is provided a system for producing hydrocarbons from a low permeability reservoir formation. The system comprises a wellbore in the low permeability reservoir formation. The wellbore has plurality of fractures in the formation induced by hydraulic fracturing at known locations. A tubular is provided that comprises an outer casing and an inner tubular member, the outer casing and the inner tubular member forming an annulus therebetween. The annulus forms a first fluid conduit located in the wellbore and arranged to transport produced hydrocarbons, and an interior of the inner tubular member forms a second fluid conduit located in the wellbore and arranged to transport an injection fluid. A set of first openings is in fluid connection with the first fluid conduit, each first opening being located to substantially align with one of a first set of fractures, and a set of second openings is in fluid connection with the second fluid conduit, each second opening being located to substantially align with one of a second set of fractures.

This system allows high pressure fluid to be injected into the second set of fractures, which pushes hydrocarbons located in the low permeability reservoir towards the first set of fractures, thereby increasing the recovery rate of hydrocarbons in the low permeability reservoir.

The system optionally includes valves located at at least some of the first set of openings. The valves are arranged to control a flow of hydrocarbons into the tubular and reduce the effects of a gas or water breakthrough.

As an option, the system includes valves located at at least some of the second set of openings, the valve arranged to control a flow of injection fluid from the tubular. This ensures an even flow rate/pressure of injection fluids at all points along the length of the well.

The system is optionally provided with at least one packer disposed in proximity to each opening of the first set of openings and a further packer disposed in proximity to each opening of the second set of openings, wherein the packers are arranged to ensure no fluid connection between the first set of openings and the second set of openings. This ensures that injection fluid does not enter the first fluid conduit.

As an option, a second wellbore is provided in the low permeability reservoir formation. The second wellbore has a plurality of fractures induced by hydraulic fracturing at known locations, and the second wellbore is located adjacent to the wellbore.

As a further option, a fracture of the plurality of fractures of the wellbore substantially aligns with a fracture of plurality of fractures of the second wellbore. This improves the efficiency of recovery of hydrocarbons, as pressure is uniformly applied to the low permeability reservoir formation.

DETAILED DESCRIPTION

Existing technology for producing hydrocarbons from reservoirs in low porosity and/or low permeability formations such as shale is to induce fractures using a high pressure fluid. The hydrocarbons are subsequently able to migrate through the fractures to a production tubular. The following description refers to shale formations, but it will be appreciated that the same techniques may be used on other types of formation having low porosity and low permeability.

Figure 1:
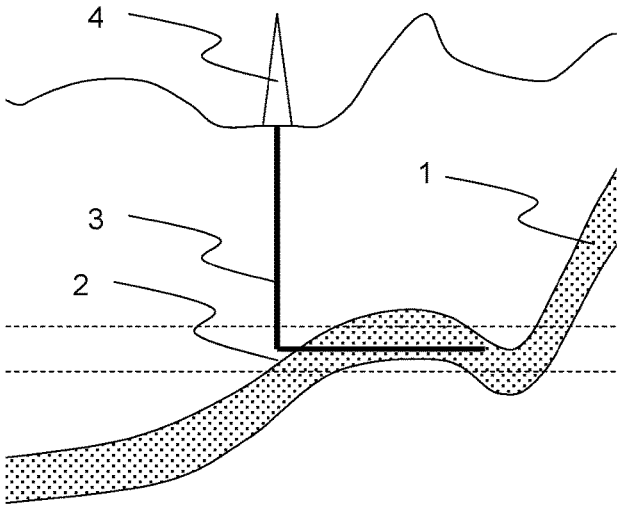
Figure 1 (prior art)
FIG. 1 illustrates schematically a cross-section of a shale reservoir in a shale formation.
Figure 2:
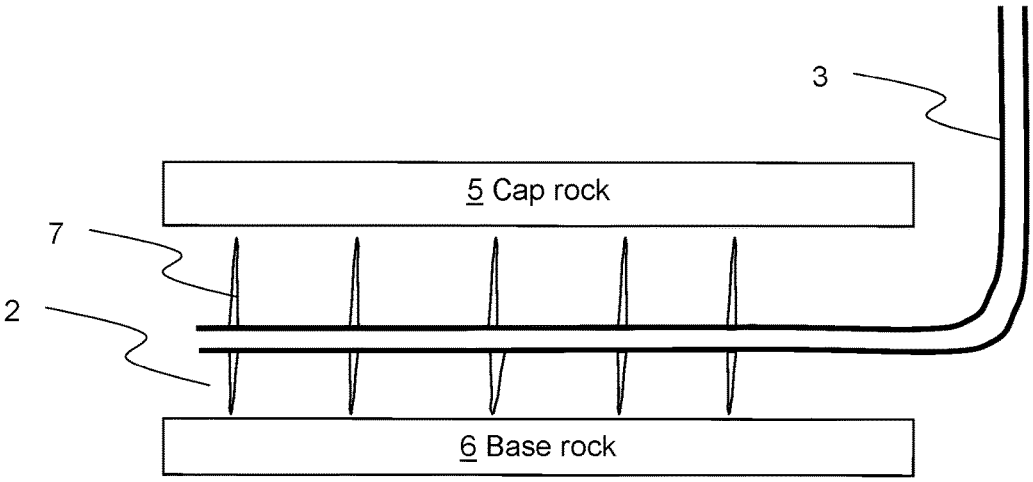
Figure 2 (prior art)
FIG. 2 illustrates schematically a cross section of a shale reservoir after a hydraulic fracturing operation.
Figure 3:
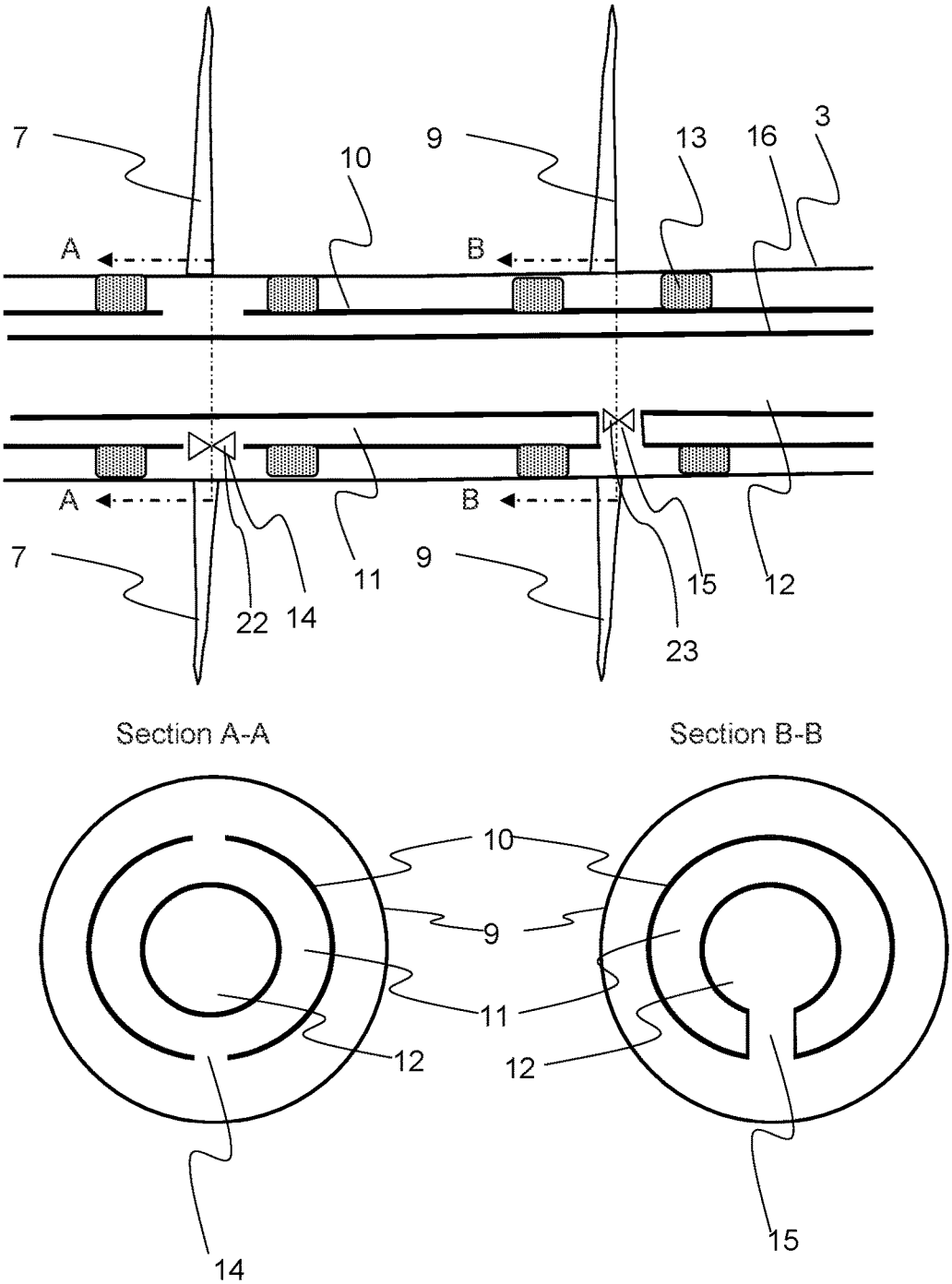
FIG. 3 illustrates schematically a side view and cross section views of an exemplary combined injection and production pipe.

FIG. 3 illustrates a section of a tubular in a horizontal well 3 that has previously been subjected to a hydraulic fracturing process. The hydraulic fracturing process has induced fractures 7, 9 in the surrounding formation. The tubular is provided with an outer casing 10 that encloses a first fluid conduit 11 and a second fluid conduit 12. Packers 13 are used to isolate different sections of the tubular within the well, and packers are located either side of a fracture 7, 9 in order to isolate the fracture 7, 9 from a gap between the well 3 and the casing 10. Pairs of packers 13 may be used, but it will be appreciated that only one packer is necessary to isolate the first fluid conduit 11 from the second fluid conduit 12.

Some of the fractures 7 (termed herein "production fractures") are used to allow hydrocarbons to migrate towards the tubular, and other fractures 9 (termed herein "injection fractures") are used for injecting high pressure fluid. The casing 10 has a first opening 14 that provides a fluid connection between the well 3 and the first fluid conduit 11. These openings are substantially aligned with the production fractures 7. The casing 10 has a second opening 15 that provides a fluid connection between the well 3 and the second fluid conduit 12. It will be appreciated that a horizontal section of the well will typically be provided with many such openings 14, 15.

In normal production, produced hydrocarbons migrate along the production fractures 7, through the first opening 14 and into the first fluid conduit 11 such that the first fluid conduit 11 carries produced hydrocarbons. The first opening 14 may be provided with known filters and sand screens, such as those used with existing production tubulars. If required, the second opening 15 may also be provided with filters and sand screens. Furthermore, the first opening 14 may be provided with a valve 22 that can autonomously shut off gas or water in the event of a breakthrough. An example of such as valve is described in WO 2008/004875, but it will be appreciated that any other type of valve may be used to control the flow of fluids into the first fluid conduit 11. The first opening 14 is disposed in a section of the casing 10 that is located between two packers 13 in order to isolate the first opening 14 in the well 3.

In normal production, the second fluid conduit 12 carries high pressure injection fluid, typically provided from a production facility 4. The injection fluid passes through the second fluid conduit 12 and through the second opening 15. As the second opening 15 is also isolated in the well by a pair of packers 13, and is disposed adjacent to an injection fracture 9, the high pressure injection fluid passes into the injection fracture. The second opening 15 may also be provided with a valve to control the volume and rate of injection fluid passing through the second opening 15.

A purpose of having a pair of packers 13 isolating the first opening 14 and a further pair of packers 13 isolating the second opening is to ensure that there is no direct fluid connection between the first conduit 11 and the second conduit 12. This would otherwise lead to a "short circuit" in which high pressure injection fluid could travel along the well 3 and enter the first fluid conduit 11.

In an embodiment, the openings 14, 15 are aligned such that each first opening 14 is adjacent along the length of the tubular to a second opening 15 on either side of the first opening 14. This has the effect of making every other fracture a production fracture 7, with injection fractures 9 between each production fracture 7. This leads to improved hydrocarbon recovery because high pressure injection fluid (typically a gas) passes into the injection fractures 9 and increases the pressure in the formation. This causes hydrocarbons in the shale formation located between fractures to move towards production fractures 7, and therefore enhances hydrocarbon recovery from the formation. Maintaining the pressure in the formation using the injection fractures 9 increases the production rate of hydrocarbons.

The use of simultaneous injection and production maintains pressure in the low permeability formation and forces hydrocarbons towards the production fractures. This technique therefore increases the hydrocarbon production rate significantly compared to a scenario in which no injection is applied. This differs from steam injection in known steam assisted gravity drainage (SAGD) techniques. For example, the disclosure of WO 2010/092338 describes techniques to lower the viscosity of heavy oils, but makes no mention of hydraulic fracturing or using pressure applied to injection fractures to "push" hydrocarbons towards production fractures.

As shown in FIG. 3, in an embodiment of the invention the outer casing 10 forms an outside wall of the first fluid conduit 11. A tubular member 16 having a smaller diameter than the outer casing 10 is disposed inside the outer casing 10. The first fluid conduit is therefore formed by an annulus defined between the outer casing 10 and the tubular member 16. The first opening 14 between the first fluid conduit and the well 3 can be formed from an opening in the outer casing. The interior of the tubular member 16 forms the second fluid conduit 12. In this case, the second opening 15 between the well 3 and the second fluid conduit 12 is a passage that passes through the annulus defining the first fluid conduit 11 to provide a fluid connection between the well 3 and the second fluid conduit 12.

An advantage of having the second fluid conduit 12 defined by the smaller diameter tubular member 16 is that the smaller diameter allows a higher pressure to be maintained in the second fluid conduit 12. However, it will be appreciated that the annulus defined by the outer casing 10 and the tubular member 16 could be used as the second fluid conduit 12 for carrying high pressure injection fluid, and the interior of the tubular member 16 could be used as the first fluid conduit for carrying produced hydrocarbons.

Figure 4A:
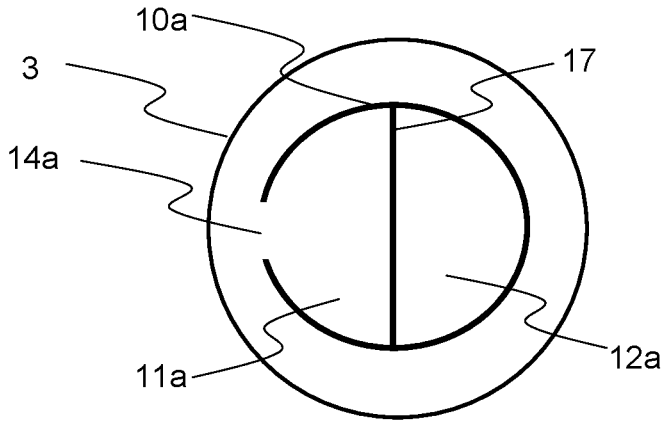
FIGS. 4A and 4B illustrate schematically cross sections of a further exemplary combined injection and production pipe at different points along a well.
Figure 4B:
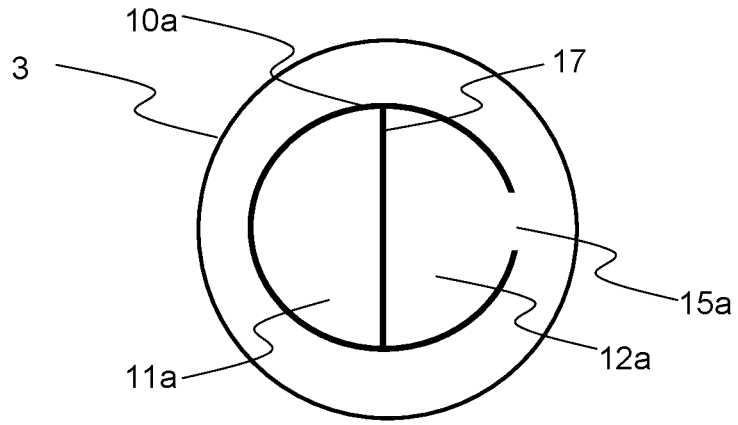

Other arrangements for providing a first fluid conduit 11 and a second fluid conduit 12 in a single outer casing 10 are possible. FIGS. 4A and 4B show cross-sections at different points along the length of a well illustrating one such example. In this example, an outer casing 10*a* in the well 3 has a dividing wall 17 dividing the outer casing into two sections 11*a*, 12*a*. One section 11*a* acts as the first fluid conduit, the other section 12*a* acts as the second fluid conduit. A first opening 14*a* provides a fluid connection between the well 3 and the first fluid conduit 11*a*, and a second opening 15*a* provides a fluid connection between the well 3 and the second fluid conduit. It will be appreciated that the openings 14*a*, 15*a* shown in FIG. 4 will in practice be offset along the length of the well 3 such that the first opening 14*a* is disposed in proximity to a production fracture 7 and the second opening 15*a* is disposed in proximity to an injection fracture 9, and that the openings 14*a*, 15*a* will be isolated by a pair of packers 13.

Figure 5:
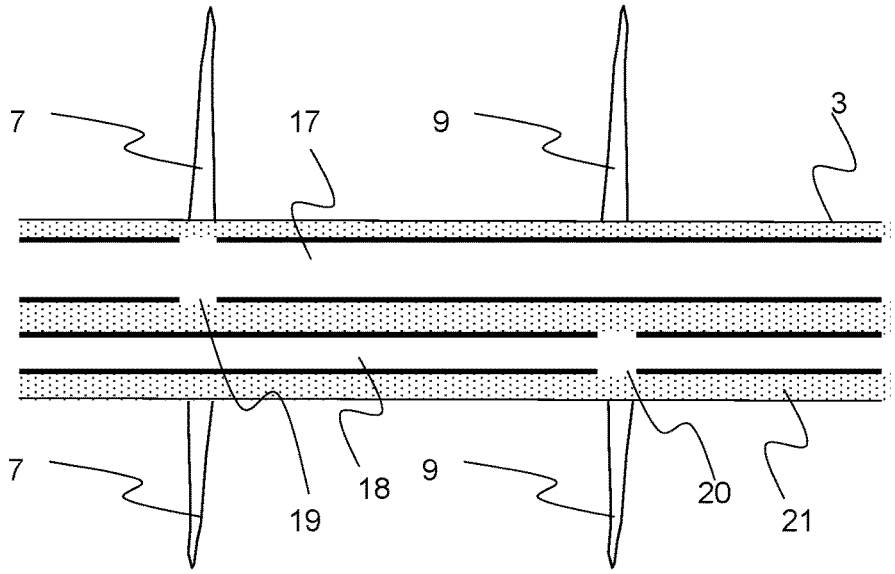
FIG. 5 illustrates schematically a side view of a further embodiment of an exemplary wellbore provided with two tubulars and a gravelpack.

As shown in FIG. 5, a further exemplary arrangement is to provide two tubulars 17, 18, hoses or pipes in the same wellbore such that a production tubular 17 is used for conveying produced hydrocarbons, and an injection tubular 18 is used for conveying injection fluid. The openings 19 in the production tubular 17 substantially line up with production fractures 7 and the openings 20 in the second tubular substantially line up with injection fractures 9.

In a further exemplary arrangement, otherwise compatible with the arrangements described above, at least some of the packers are replaced with a gravelpack. As shown in FIG. 5, gravelpack 21 performs the function of the packers of FIG. 3, in that the gravelpack 21 restricts the flow of fluid in the annulus between the well 3 and the outer casing 10 (or, in the case of two tubulars, between the production tubular 17 and the injection tubular 18). The gravelpack 21 is unlikely to completely prevent injection fluids from entering the first openings 14, 19 but it reduces the flow of injection fluids into the first openings 14, 19 to an acceptable level. Note that a gravelpack 21 along the entire length of the tubular could be used to replace packers 13 altogether. The use of a gravelpack 21 may be particularly suitable for the exemplary embodiment shown in FIG. 5 in which two tubulars 17, 18 are used. The tubulars could otherwise be difficult to isolate using packers. The use of a gravelpack 21 also reduces the operational complexities in locating the packers 13, and the absence of packers 13 also means there is no risk of a packer failure leading to injection fluids entering the production tubular.

Figure 6:
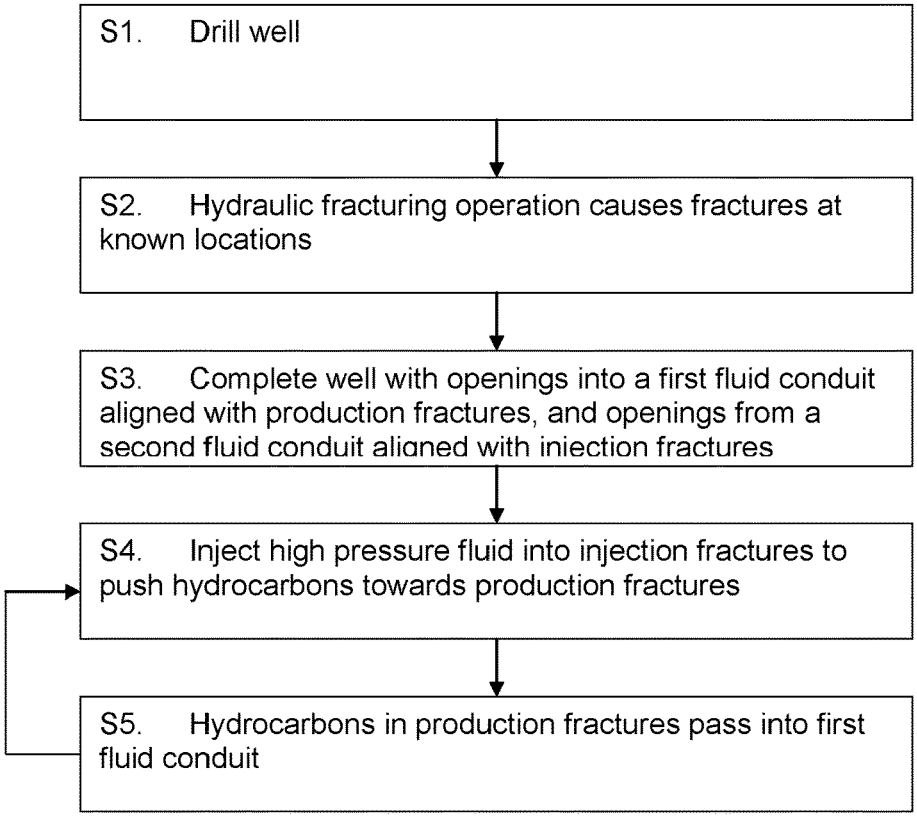
FIG. 6 is a flow diagram showing steps of operating a combined injection and production pipe.

FIG. 6 is a flow diagram illustrating exemplary steps of fitting and operating a production tubular in a shale reservoir. The following numbering corresponds to that of FIG. 6:

S1. The well is drilled into the reservoir. It may or may not have a cemented liner installed.

S2. Hydraulic fracturing is induced at known locations in the well. The locations for fractures are selected based on reservoir modelling and geomechanical considerations to optimize production from the well. The fractures are shown as being oriented with a main axis substantially perpendicular to the well, but it will be appreciated that this is not always necessary and in some cases may be hindered by geological considerations. This is achieved by drilling the well in the direction of the least horizontal stress. An advantage of orienting fractures with a main axis substantially perpendicular to the well 3 is that it makes it easier to align the fractures with fractures from adjacent wells, as described in more detail below.

S3. The well is completed using a combined injection and production tubular as described above in FIG. 3. The first openings 14 are located adjacent to production fractures 7 and the second openings 15 may be located adjacent to injection fractures 9, and the fractures are isolated by at least one or more packers 13 (FIG. 3 shows a pair of packers 13 around each opening, but it will be appreciated that any number of packers can be used if it prevents or restricts a flow of fluid between the first and second openings). As described above, a typical arrangement is for each alternate fracture to be a production fracture 7 and the fractures between the production fractures 7 to be injection fractures 9. Packers are disposed between the outer casing 10 and the well in such a way as to isolate the first opening 14 from the second opening 15.

S4. High pressure injection fluid is passed through the second fluid conduit 12 and into the injection fractures 9. This increases the pressure in the reservoir around each injection fracture, causing hydrocarbons in the reservoir to be pushed towards adjacent production fractures 7 on either side of each injection fracture.

S5. Hydrocarbons that are pushed towards the production fractures 7 pass along the production fractures 7 and through the first openings 14 into the first fluid conduit 11, allowing the hydrocarbons to be produced from the well 3. Steps S4 and S5 run simultaneously. The fluid isolation of the first fluid conduit from the second fluid conduit means that injection and production are performed simultaneously, and the injection operation enhances the production.

Figure 7:
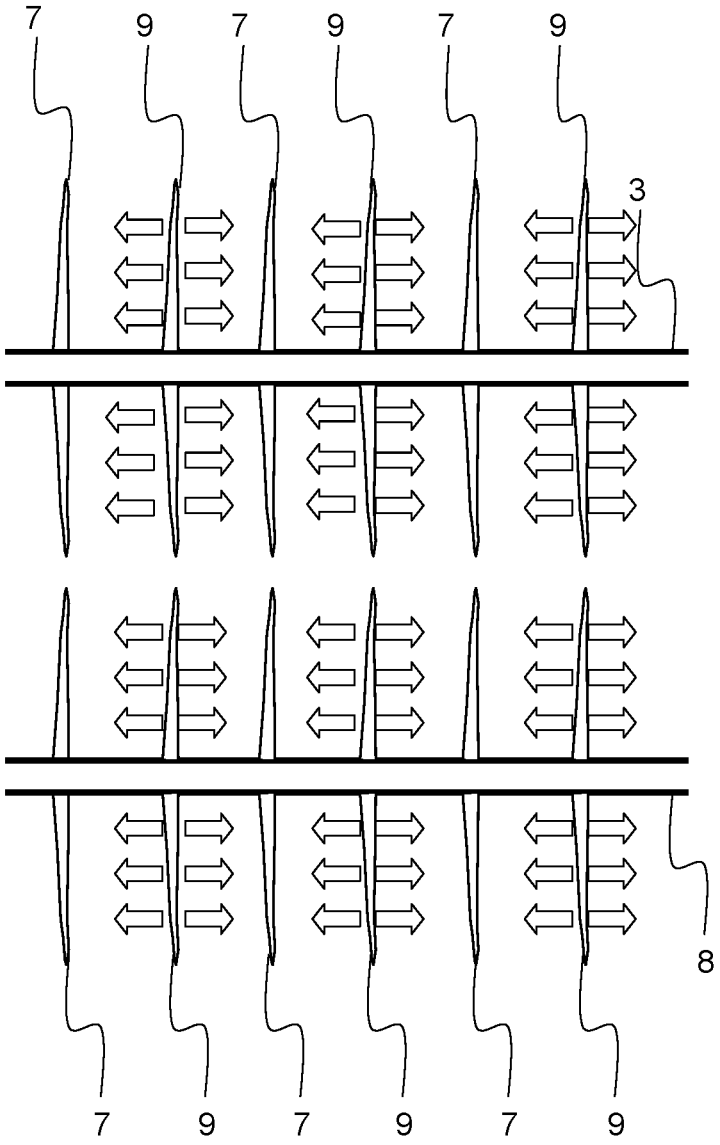
FIG. 7 illustrates schematically a view of exemplary adjacent wells.

It will not always be possible to line up the production fractures 7 and the injection fractures 9 from each well 3, 8 as shown in FIG. 7. However, even if this alignment cannot be achieved, production of hydrocarbons is still enhanced. The first 3 and second 8 wells may be disposed substantially side by side or above and below one another.

Figure 8:
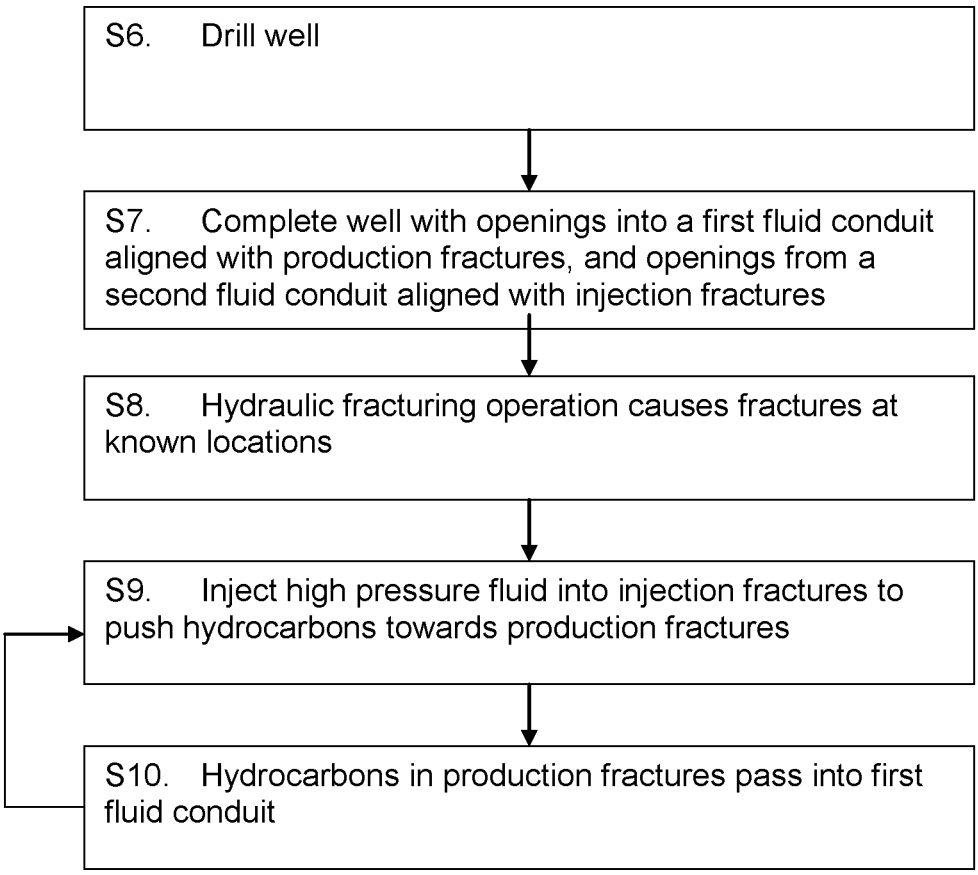
FIG. 8 is a flow diagram showing steps of an alternative method of installing and operating combined injection and production pipe.

Turning now to FIG. 8, there is illustrated a further method that addresses the above problem. The following numbering corresponds to that of FIG. 8:

S6. The well is drilled into the reservoir. It may or may not have a cemented liner installed.

S7. The well is completed using a combined injection and production tubular as described above. The first openings 14 are located adjacent to production fractures 7 and the second openings 15 may be located adjacent to injection fractures 9, and the fractures are isolated by at least one or more packers 13 (FIG. 3 shows a pair of packers 13 around each opening, but it will be appreciated that any number of packers can be used if it prevents or restricts a flow of fluid between the first and second openings). As described above, a typical arrangement is for each alternate fracture to be a production fracture 7 and the fractures between the production fractures 7 to be injection fractures 9.

S8. Hydraulic fracturing is induced at known locations in the well. The locations for fractures are selected based on reservoir modelling and geomechanical considerations to optimize production from the well. Hydraulic fracturing may be performed using both the first openings 14 and the second openings 15. This ensures that during subsequent simultaneous injection and production, the induced fractures are substantially aligned with the first openings 14 and second openings 15, and eliminates the need to align the openings with the fractures during a subsequent completion operation.

S9. High pressure injection fluid is passed through the second fluid conduit 12 and into the injection fractures 9. This increases the pressure in the reservoir around each injection fracture, causing hydrocarbons in the reservoir to be pushed towards adjacent production fractures 7 on either side of each injection fracture.

S10. Hydrocarbons that are pushed towards the production fractures 7 pass along the production fractures 7 and through the first openings 14 into the first fluid conduit 11, allowing the hydrocarbons to be produced from the well 3.

Steps S9 and S10 occur simultaneously. The fluid isolation of the first fluid conduit from the second fluid conduit means that injection and production are performed simultaneously, and the injection operation enhances the production.

The use of a combined injection/production tubular to allow continuous injection of high pressure fluids into a reservoir at the same time as producing hydrocarbons that are moved by the increased pressure can significantly increase the hydrocarbon recovery and production rate in certain reservoirs. This type of system is particularly suitable to reservoirs in low porosity, low permeability formations that use hydraulic fracturing. It may be used in other types of reservoirs provided there is sufficient porosity to allow efficient high pressure fluid injection.

It will be appreciated by a person of skill in the art that various modifications may be made to the embodiments described above without departing from the scope of the present disclosure.

In an alternative embodiment, there is provided a method of completing a well for producing hydrocarbons from a low permeability reservoir formation. A wellbore is drilled into the low permeability reservoir formation. A hydraulic fracturing operation is performed to induce a plurality of fractures in the reservoir at known locations. Each fracture is designated as either one of a first set of fractures or one of a second set of fractures. The well is completed using a first fluid conduit arranged to transport produced hydrocarbons and a second fluid conduit arranged to transport an injection fluid. A set of first openings is provided in fluid connection with the first fluid conduit, each first opening being located to substantially align with one of the first set of fractures. A set of second openings is provided in fluid connection with the second fluid conduit, each second opening being located to substantially align with one of the second set of fractures. This allows, in use, injection fluid to be applied to the second set of fractures which increase the pressure in the formation and pushes hydrocarbons towards the first set of fractures, making hydrocarbons easier to produce.

A valve may be provided to at least some of the first set of openings, the valve arranged to control a flow of hydrocarbons into the first fluid conduit. This allows flow to be controlled or substantially shut of in the event of an unwanted water or gas breakthrough. Valves may also be provided to at least some of the second set of openings, the valve arranged to control a flow of injection fluid from the second fluid conduit. An advantage of this is that, in use, the valves can maintain a similar pressure and/or flow rate of injection fluid into the second set of fractures along the length of the well, to maintain an even pressure of injection fluid in the low permeability formation.

A packer may be disposed in proximity to the first set of openings and a further packer is disposed in proximity to the second set of openings. The packers are arranged to ensure no fluid connection between the first set of openings and the second set of openings. In some circumstances, a gravelpack is optionally used instead of packers. While the gravelpack may not ensure that there is no fluid connection between the first and second sets of openings, it will restrict the flow of fluids between the first and second sets of openings and this may be within acceptable levels.

An example of a low permeability reservoir formation is a shale formation.

The first set of fractures and the second set of fractures may be disposed along a main axis of the well such that a fracture of the first set of fractures alternates with a fracture of the second set of fractures. This allows more even distribution of pressure from the injection fluid within the well and ensures that as much of the reservoir as possible can be subject to pressure from the injection fluid to increase hydrocarbon production.

The first fluid conduit and the second fluid conduit may be disposed in a tubular comprising an outer casing, and the first set of openings and the second set of openings are located in the outer casing. In this case, the second fluid conduit may form an inner conduit, and the first fluid conduit may be formed in the annulus between the second fluid conduit and the outer casing. An advantage of having the second fluid conduit as the inner conduit is that it has a smaller diameter and can therefore more easily maintain the high pressure required for the injection fluid.

In this embodiment, a well in a low permeability reservoir formation is provided with a plurality of hydraulic fractures, each fracture being designated as one of a first set of fractures and a second set of fractures. An injection fluid is injected into at least one of the second set of fractures to increase a pressure in the low permeability reservoir. Hydrocarbons are simultaneously produced from at least one of the first set of fractures such that the hydrocarbons flow into a production tubular. The flow of hydrocarbons into the production tubular may be controlled using a valve to limit gas or water breakthrough. A flow of injection fluid may be controlled using a further valve. This allows a substantially uniform flow rate and/or pressure to be injected to all of the second set of fractures. At least one packer may be provided in proximity to an opening of the first set of openings, and a further packer is disposed in proximity to an opening of the second set of openings. The use of packers ensures that there is no fluid connection between the first set of openings and the second set of openings. It will be appreciated that the steps of injecting an injection fluid and producing hydrocarbons may occur simultaneously or sequentially.

In this embodiment, a tubular for producing hydrocarbons from a low permeability reservoir formation is provided with an outer casing, a first fluid conduit arranged to transport produced hydrocarbons, a second fluid conduit arranged to transport an injection fluid, a first opening in the outer casing in fluid connection with the first fluid conduit, and a second opening in the outer casing in fluid connection with the second fluid conduit. The first fluid opening may further comprise a valve, the valve arranged to control a flow of hydrocarbons into the first fluid conduit. This reduces the risk of water or gas being produced in the event of a water or gas breakthrough. The second fluid opening may comprises a further valve 23, the further valve 23 arranged to control a flow of injection fluid out of the second fluid conduit. This allows even distribution of injection fluid into the formation at all points along the length of the well. The tubular may be provided with a first packer disposed in proximity to the first opening and a second packer disposed in proximity to the second opening, wherein the packers are arranged to ensure no fluid connection between the first opening and the second opening, thereby reducing the risk of injection fluid entering the first fluid conduit.

In this embodiment, a system comprises a wellbore in the low permeability reservoir formation. The wellbore has plurality of fractures in the formation induced by hydraulic fracturing at known locations. A first fluid conduit is located in the wellbore and arranged to transport produced hydrocarbons. A second fluid conduit is located in the wellbore and arranged to transport an injection fluid. A set of first openings is provided in fluid connection with the first fluid conduit, each first opening being located to substantially align with one of a first set of fractures. A set of second openings is provided in fluid connection with the second fluid conduit, each second opening being located to substantially align with one of a second set of fractures. This system allows high pressure fluid to be injected into the second set of fractures, which pushes hydrocarbons located in the low permeability reservoir towards the first set of fractures, thereby increasing the recovery rate of hydrocarbons in the low permeability reservoir. The first fluid conduit and the second fluid conduit may be disposed in a tubular comprising an outer casing, and the first set of openings and the second set of openings are located in the outer casing. The system may include valves located at at least some of the first set of openings. The valves are arranged to control a flow of hydrocarbons into the tubular and reduce the effects of a gas or water breakthrough. Similarly, the system may include valves located at at least some of the second set of openings, the valve arranged to control a flow of injection fluid from the tubular. This ensures an even flow rate/pressure of injection fluids at all points along the length of the well. The system may be provided with at least one packer disposed in proximity to each opening of the first set of openings and a further packer disposed in proximity to each opening of the second set of openings, wherein the packers are arranged to ensure no fluid connection between the first set of openings and the second set of openings. This ensures that injection fluid does not enter the first fluid conduit.

It is also possible to provide a second wellbore in the low permeability reservoir formation. The second wellbore has a plurality of fractures induced by hydraulic fracturing at known locations, and the second wellbore is located adjacent to the wellbore. A fracture of the plurality of fractures of the wellbore may substantially align with a fracture of plurality of fractures of the second wellbore. This improves the efficiency of recovery of hydrocarbons, as pressure is uniformly applied to the low permeability reservoir formation.

The invention claimed is:

1. A method of completing a well for producing hydrocarbons from a low permeability reservoir formation, the method comprising:

drilling a wellbore into the low permeability reservoir formation;

performing a hydraulic fracturing operation to induce a plurality of fractures in the reservoir at known locations;

designating a first set of fractures and a second set of fractures;

completing the well using a tubular, the tubular comprising an outer casing providing a first fluid conduit arranged to transport produced hydrocarbons and a second fluid conduit arranged to transport an injection fluid, wherein the outer casing comprises a dividing wall dividing the outer casing into two sections, one of the two sections forming the first fluid conduit and the other of the two sections forming the second fluid conduit, a set of first openings in fluid connection with the first fluid conduit, each first opening being located to substantially align with one of the first set of fractures, and a set of second openings in fluid connection with the second fluid conduit, each second opening being located to substantially align with one of the second set of fractures, wherein each first opening is offset along a length of the tubular relative to the nearest opening that is in fluid connection with the second fluid conduit.

2. The method according to claim 1, further comprising providing a valve to at least some of the first set of openings, the valve arranged to control a flow of hydrocarbons into the first fluid conduit.

3. The method according to claim 1 or 2, further comprising providing a valve to at least some of the second set of openings, the valve arranged to control a flow of injection fluid from the second fluid conduit.

4. The method according to claim 1, further comprising providing at least one packer disposed in proximity to an opening of the first set of openings and a further packer disposed in proximity to an opening of the second set of openings, wherein the packers are arranged to ensure no fluid connection between the first set of openings and the second set of openings.

5. The method of completing a well for producing hydrocarbons from a low permeability reservoir formation according to claim 1, wherein the low permeability reservoir formation comprises a shale formation.

6. The method according to claim 1, wherein the first set of fractures and the second set of fractures are disposed along a main axis of the well such that a fracture of the first set of fractures alternates with a fracture of the second set of fractures.

7. A method of producing hydrocarbons from a low permeability reservoir formation, the method comprising, in a well in a low permeability reservoir formation, the well comprising a plurality of hydraulic fractures, each fracture being designated as one of a first set of fractures and a second set of fractures:

injecting an injection fluid from one of two sections of an outer casing of a tubular into at least one of the second set of fractures to increase a pressure in the low permeability reservoir, wherein the outer casing comprises a dividing wall dividing the outer casing into the two sections; and producing hydrocarbons from at least one of the first set of fractures such that the hydrocarbons flow into the other of the two sections of the outer casing, wherein the tubular comprises a set of first openings in fluid connection with the first fluid conduit, each first opening being located to substantially align with one of the first set of fractures, and a set of second openings in fluid connection with the second fluid conduit, each second opening being located to substantially align with one of the second set of fractures, wherein each first opening is offset along a length of the tubular relative to the nearest opening that is in fluid connection with the second fluid conduit.

8. The method according to claim 7, further comprising controlling a flow of hydrocarbons into the production tubular using a valve.

9. The method according to claim 7 or 8, further comprising controlling a flow of injection fluid using a further valve.

10. The method according to claim 7, further comprising providing at least one packer disposed in proximity to an opening of the first set of openings and a further packer disposed in proximity to an opening of the second set of openings, wherein the packers are arranged to ensure no fluid connection between the first set of openings and the second set of openings.

11. The method according to claim 7, wherein the injection fluid comprises a gas.

12. The method according to claim 7, wherein the injection of injection fluid occurs simultaneously with the production of hydrocarbons.

13. A tubular for producing hydrocarbons from a low permeability reservoir formation, the tubular comprising:

an outer casing comprising a dividing wall dividing the outer casing into two sections;

wherein one of the two sections forms a first fluid conduit arranged to transport produced hydrocarbons;

the other of the two sections forms a second fluid conduit arranged to transport an injection fluid;

a first opening in the outer casing in fluid connection with the first fluid conduit, the first opening arranged to substantially align with a first fracture in the formation; and a second opening in the outer casing in fluid connection with the second fluid conduit, the second opening arranged to substantially align with a second fracture in the formation, wherein the first opening is offset along a length of the tubular relative to the nearest opening that is in fluid connection with the second fluid conduit.

14. The tubular according to claim 13, wherein the first opening further comprises a valve, the valve arranged to control a flow of hydrocarbons into the first fluid conduit.

15. The tubular according to claim 13, wherein the second opening further comprises a further valve, the further valve arranged to control a flow of injection fluid out of the second fluid conduit.

16. The tubular according to claim 13, further comprising a first packer disposed in proximity to the first opening and a second packer disposed in proximity to the second opening, wherein the packers are arranged to ensure no fluid connection between the first opening and the second opening.

17. A system for producing hydrocarbons from a low permeability reservoir formation, the system comprising:

a wellbore in the low permeability reservoir formation, the wellbore having a plurality of fractures in the formation induced by hydraulic fracturing at known locations;

a tubular comprising an outer casing, wherein the outer casing comprises a dividing wall dividing the outer casing into two sections;

one of the two sections forming a first fluid conduit located in the wellbore and arranged to transport produced hydrocarbons;

the other of the two sections forming a second fluid conduit located in the wellbore and arranged to transport an injection fluid;

a set of first openings in fluid connection with the first fluid conduit, each first opening being located to substantially align with one of a first set of fractures;

and a set of second openings in fluid connection with the second fluid conduit, each second opening being located to substantially align with one of a second set of fractures, wherein the first opening is offset along a length of the tubular relative to the nearest opening that is in fluid connection with the second fluid conduit.

18. The system according to claim 17, further comprising a valve at at least some of the first set of openings, the valve arranged to control a flow of hydrocarbons into the tubular.

19. The system according to claim 17 or 18, further comprising a further valve at at least some of the second set of openings, the valve arranged to control a flow of injection fluid from the tubular.

20. The system according to claim 17, further comprising at least one packer disposed in proximity to each opening of the first set of openings and a further packer disposed in proximity to each opening of the second set of openings, wherein the packers are arranged to ensure no fluid connection between the first set of openings and the second set of openings.

21. The system according to claim 17, further comprising:

a second wellbore in the low permeability reservoir formation, the second wellbore having plurality of fractures induced by hydraulic fracturing at known locations, and the second wellbore being located adjacent to the wellbore.

22. The system according to claim 17, wherein a fracture of the plurality of fractures of the wellbore substantially aligns with a fracture of plurality of fractures of the second wellbore.

* * * * *